United States Patent [19]

White

[11] 3,965,625

[45] June 29, 1976

[54] CANOPY SUPPORT TOWERS WITH ADJUSTABLE CANOPY

[75] Inventor: Stevan C. White, Des Moines, Iowa

[73] Assignee: Music Circuit Productions, Inc., Des Moines, Iowa

[22] Filed: Apr. 2, 1975

[21] Appl. No.: 564,304

[52] U.S. Cl. ..... 52/29; 135/5 R; 135/15 CF; 254/148

[51] Int. Cl.[2] ..... B66B 9/00

[58] Field of Search ..... 52/6, 29, 66, 83

[56] References Cited

UNITED STATES PATENTS

| | | | |
|---|---|---|---|
| 1,714,990 | 5/1929 | Schmid | 52/29 |
| 2,415,202 | 2/1947 | Ferguson | 52/83 |
| 2,508,679 | 5/1950 | McClellan et al. | 135/1 |
| 2,921,592 | 1/1960 | Mackey | 52/83 |
| 3,288,158 | 11/1966 | Gugliotta | 52/83 |
| 3,510,996 | 5/1970 | Popil | 52/83 |
| 3,842,941 | 10/1974 | Gerber | 52/29 |

FOREIGN PATENTS OR APPLICATIONS

| | | | |
|---|---|---|---|
| 304,612 | 1/1933 | Italy | 52/83 |

*Primary Examiner*—Werner H. Schroeder
*Assistant Examiner*—Conrad L. Berman
*Attorney, Agent, or Firm*—Zarley, McKee, Thomte & Voorhees

[57] ABSTRACT

A support tower is disclosed for use in supporting a canopy which may be extended over a stage or the like. The tower has an adjustable base secured to the lower end thereof and a platform selectively vertically mounted thereon. A winch means is operatively connected to the platform and the upper end of the tower for selectively moving the platform between the upper and lower ends of the tower. An elongated angle member is secured to the platform and has a plurality of spaced apart brackets secured thereto. The brackets are adapted to detachably receive one end of a cable tightener. The other end of the cable tightener is connected to a canvas loop secured to the periphery of the canopy. A plurality of individual towers may be tied together by braces or the like so that the towers may support a large canopy.

7 Claims, 4 Drawing Figures

CANOPY SUPPORT TOWERS WITH ADJUSTABLE CANOPY

BACKGROUND OF THE INVENTION

Outdoor productions such as concerts or the like frequently encounter inclement weather. The portable stages used in the outdoor performances are ordinarily quite large and it is extremely difficult to provide any type of overhead protection for the stage in case of inclement weather.

Therefore, it is a principal object of the invention to provide a support tower which may be used to support a canopy extending over a stage or the like.

A further object of the invention is to provide a support tower for a canopy which is easy to erect and which is extremely durable in use.

A still further object of the invention is to provide a canopy support tower having means thereon for supporting a canopy.

A still further object of the invention is to provide a canopy support tower including means for raising and lowering the canopy secured thereto.

A still further object of the invention is to provide a canopy support tower which is extremely stable.

A still further object of the invention is to provide a canopy support tower which is refined in appearance.

These and other objects will be apparent to those skilled in the art.

BRIEF DESCRIPTION OF THE DRAWINGS

This invention consists in the construction, arrangements and combination of the various parts of the device, whereby the objects contemplated are attained as hereinafter more fully set forth, specifically pointed out in the claims, and illustrated in the accompanying drawings, in which:

DESCRIPTION OF THE PREFERRED EMBODIMENT

Figure 1:
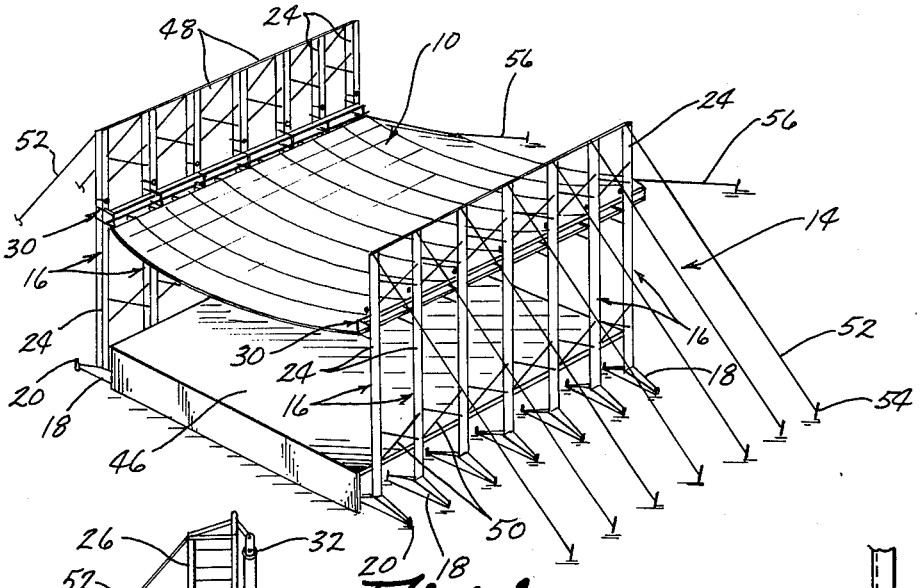
FIG. 1 is a perspective view of the towers of this invention being employed to support a canopy.

In the drawings, the numeral 10 refers generally to a flexible canopy preferably constructed of a high-strength, rubberized nylon. Canopy 10 is provided with a plurality of spaced apart loop elements 12 secured thereto at the periphery thereof. The support system for supporting the canopy is referred to generally by the reference numeral 14 and generally comprises a plurality of support towers 16.

Each of the towers 16 generally comprises a base 18 having leveler legs 20 and 22 provided thereon. A plurality of tower sections 24 are secured together in an end-to-end relationship and extend upwardly from the base 18 as illustrated in the drawings. The support tower 16 may be comprised of a single tower section 24 but it is more versatile if a plurality of tower sections are employed. Tower cap 26 is secured to the uppermost tower section 24 and is provided with a cable hook 28 at the upper end.

Figure 2:
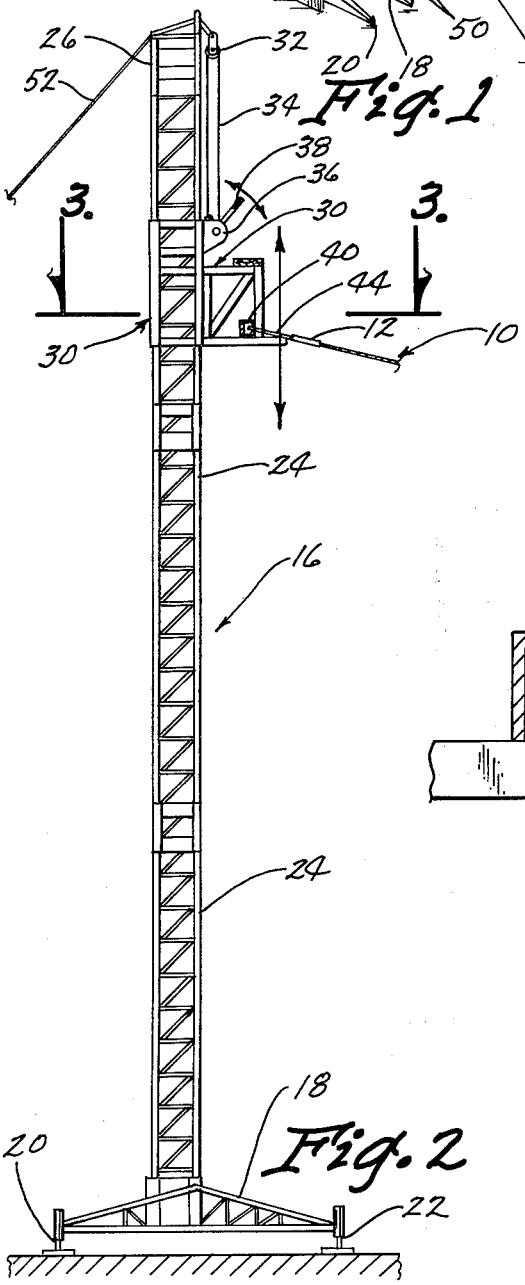
FIG. 2 is a side view of the canopy support tower of this invention.
Figure 3:
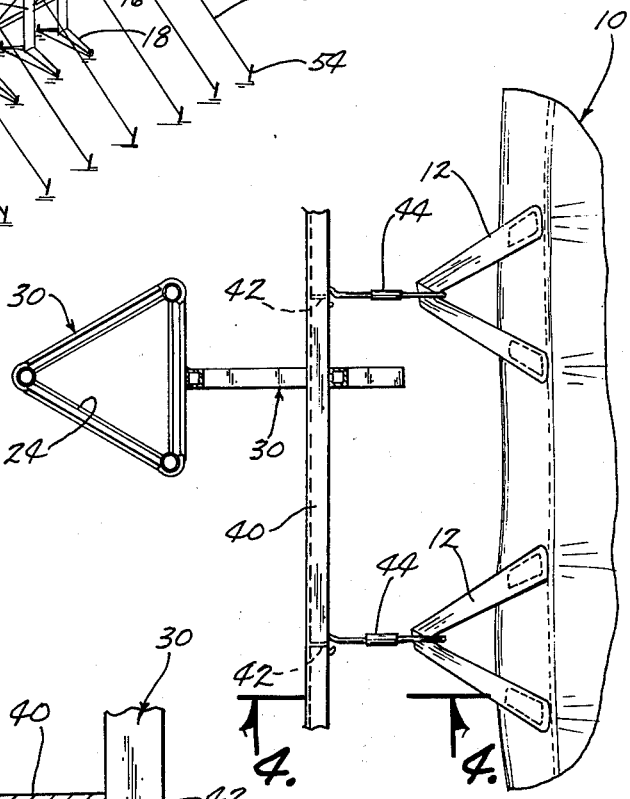
FIG. 3 is an enlarged sectional view seen on lines 3—3 of FIG. 2.
Figure 4:
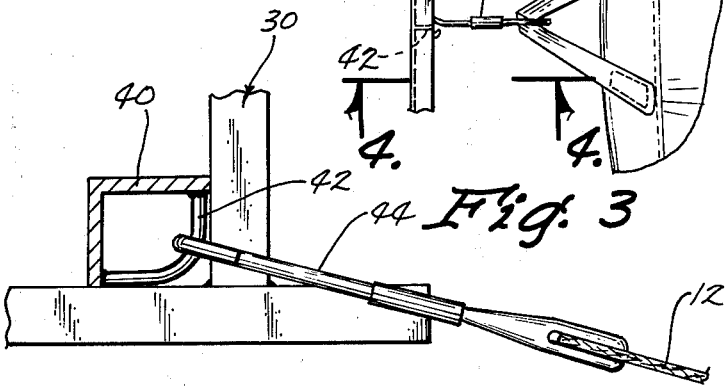
FIG. 4 is an enlarged sectional view seen on lines 4—4 of FIG. 3.

The numeral 30 refers to a platform which slidably embraces the support towers 16 as illustrated in FIGS. 2 and 3. Pulley 32 is secured to cable hook 28 and has cable 34 extending thereover. Cable 34 is connected to a conventional winch 36 by any convenient means so that actuation of the ratchet lever 38 causes the platform 30 to be either raised or lowered relative to the support tower 16. The numeral 40 refers to an elongated angle member which extends through the platform frame work of the various towers 16 as illustrated in FIGS. 3 and 4. A plurality of spaced apart brackets 42 are secured to the member 40 and are adapted to detachably receive one end of a conventional length adjustable chain or cable tightener 44. The other end of chain tightener 44 is adapted to be secured to one of the loop elements 12 as illustrated in FIGS. 3 and 4.

The support towers 16 would normally be positioned on opposite sides of a portable stage referred to generally by the reference numeral 46 in the manner illustrated in FIG. 1. The individual towers 16 have stringer braces 48 secured to and extending between the upper ends thereof. A plurality of cross braces 50 are also secured to and extend between the tower 16 as illustrated in FIG. 1. Preferably, a guy wire 52 is also secured to the towers and extends downwardly therefrom to a suitable ground anchor referred to generally by the reference numeral 54.

After the towers 16 have been erected, the platforms 30 would normally be positioned in their lowermost position adjacent the bases 18. The elements 44 are connected to the loop elements 12 of the canopy and would be adjusted to provide the proper tension on the canopy 10. Individual workers position themselves on each of the platforms 30 and simultaneously operate the winches to cause the platforms and the canopy to be simultaneously moved upwardly relative to the respective towers. While the drawings illustrate that the platforms 30 are raised by means of a manual winch, it should be understood that an electric winch could also be substituted for the manual winch. The platforms 30 are raised until the canopy has been positioned in the desired position over the stage 46. The workers would then descend from the platforms 30. If desired, one end of the canopy 10 may be stabilized through the use of guy wires 56. When it is desired to lower the canopy, the procedure just described is reversed.

Thus it can be seen that a very stable supporting structure has been provided for a canopy which insures that the canopy will be securely maintained in the desired position relative to a stage 46 or the like should inclement weather be encountered. The canopy 10 also provides shade for the performers employing the stage 46. The structure described is safe to use and permits the protective canopy to be quickly and easily mounted over the stage.

Thus it can be seen that the device accomplishes at least all of its stated objectives.

I claim:

1. In combination, a flexible canopy having opposite ends and opposite sides, said canopy having a plurality of spaced-apart loop elements secured thereto adjacent the opposite sides thereof, a plurality of spaced-apart and vertically disposed towers positioned at each of the opposite sides of said canopy, each of said towers having a platform means selectively vertically movably mounted thereon, means connected to said platform means for selectively raising and lowering said platform means relative to said tower and connection means operatively secured to and extending between said platform means and adjacent towers at one side of said canopy for connection to said loop elements at said one side of said canopy whereby said canopy may be extended between and vertically movably supported by the towers at the opposite sides thereof; said connection means comprises an elongated member secured to and extending between said platforms, spaced apart brackets secured to said elongated member, and means secured to each of said brackets and one of said loop elements.

2. The combination of claim 1 wherein said means for selectively raising and lowering said platform comprises a winch means.

3. The combination of claim 2 wherein said winch means is a manually operated winch.

4. The combination of claim 2 wherein said winch means is an electric winch.

5. The combination of claim 1 wherein said canopy is comprised of a rubberized nylon material.

6. The combination of claim 1 wherein bracing means is secured to and extends between adjacent towers.

7. The combination of claim 1 wherein said means secured to each of said brackets comprises a turnbuckle means so as to be length adjustable.

* * * * *